United States Patent [19]

Noyes

[11] 4,149,844

[45] Apr. 17, 1979

[54] OPTIMUM CONTINUOUS FLOW GRAIN DRYING AND CONDITIONING METHOD AND APPARATUS

[75] Inventor: Ronald T. Noyes, Frankfort, Ind.

[73] Assignee: Beard Industries, Inc., Frankfort, Ind.

[21] Appl. No.: 831,556

[22] Filed: Sep. 8, 1977

[51] Int. Cl.[2] ..... F26B 11/12; F27B 15/18

[52] U.S. Cl. ..... 432/17; 432/97; 432/101; 34/56; 34/174; 34/175

[58] Field of Search ..... 34/64–66, 34/165, 167, 169, 170, 171, 174, 50, 56, 26, 28, 29; 432/14, 17, 95–97, 101

[56] References Cited

U.S. PATENT DOCUMENTS

| | | | |
|---|---|---|---|
| 2,548,262 | 4/1951 | Hintz | 34/171 |
| 2,654,590 | 10/1953 | Molenaar | 34/174 |
| 2,732,630 | 1/1956 | Markowich | 34/174 |
| 3,053,522 | 9/1962 | Applegate | 34/174 |
| 3,474,903 | 10/1969 | Ausherman | 34/175 |
| 3,629,954 | 12/1971 | Lavalier | 34/174 |
| 3,751,824 | 8/1973 | Kyle | 34/174 |
| 3,896,562 | 7/1975 | Zimmerman | 34/174 |
| 4,004,351 | 1/1977 | Sanheman et al. | 34/56 |

*Primary Examiner*—Henry C. Yuen
*Attorney, Agent, or Firm*—Henderson and Sturm

[57] ABSTRACT

A continuous grain drying and conditioning apparatus of a type including a burner and blower, or a multiplicity of burners and blowers, surrounded by a plenum chamber, air pervious grain holding walls positioned outwardly with respect to the plenum chamber is characerized by having a plenum divider which is selectively adjustable in position to divide the grain holding walls into a heating section and a cooling section. Grain turning apparatus is disposed in the grain column for separating the grain mass into two separate divisions and then turning the cooler-wetter grain inwardly as it moves downwardly and turning the hotter-dryer grain outwardly as it moves downwardly in the grain column. Grain is constantly removed from the bottom of the apparatus at a rate governed by the average temperature of the air exiting the grain at a point adjacent the position of the plenum divider and a point closer to the input of the grain. Grain to be dried and conditioned is constantly introduced into the top of the apparatus as fast as dried and conditioned grain is delivered out of the bottom of the apparatus. Structure is also provided for recycling unsaturated exhaust air back through the dryer.

35 Claims, 16 Drawing Figures

OPTIMUM CONTINUOUS FLOW GRAIN DRYING AND CONDITIONING METHOD AND APPARATUS

BACKGROUND OF THE INVENTION

The present invention relates generally to grain drying equipment and more particularly to an improved continuous flow grain dryer.

It is generally believed that continuous flow dryers, that is, those dryers which have wet grain continually entering the dryer and dried grain continually exiting the dryer, were not suitable for drying grains having a high moisture content. The reason for the difficulties experienced in the use of conventional continuous flow dryers was that they only operated at their optimum design performance over a fairly narrow band of moisture removal range due to fixed design conditions such as a fixed cooling air flow, a fixed cooling plenum exhaust area, a fixed heated air flow and a fixed heat plenum exhaust area.

At a grain moisture removal of 6 to 8 percentage points, most conventional dryers work very well. The cooling rate is matched fairly well with the drying rate. The grain column is usually split 25–35 percent cooling and 65–75 percent heating. The total blower horsepower is normally split to be 30–40 percent cooling and 60–70 percent drying. Dryers with a 25 percent cooling column usually use the upper extreme in cooling horsepower, thus operating the cooling plenum at a higher static pressure than the heating plenum and delivering 50–100 percent more cool air per bushel than drying air.

Under conditions wherein grain coming from the field is very high in moisture, and the drying rate is slowed significantly, the grain in such prior art systems was over cooled, which is not a particular problem from the standpoint of the quality of the grain dried, but it does waste considerable energy. Under very dry grain inlet conditions wherein the moisture removal is in the 3–5 percentage range, cooling is inadequate. If grain conditioned by such a process is to be stored in a non-aerated storage and therefore had to be cooled considerably after being dried in the dryer, the only reasonable solution was believed to be to cut back on the drying temperature to drastically slow down the drying rate to the point at which the grain retention time in the cooling zone was adequate to cool the grain. It is of course well known that the grain to be stored in non-aerated storage cannot be too hot or it will deteriorate. There is, therefore, the need for a continuous flow drying apparatus which will overcome these problems found with prior art devices.

Another weakness with most conventional continuous flow column grain drying devices is that the moisture is monitored near the base of the drying column. Consequently, the flow of grain would not be varied if wetter or drier grain is to suddenly be introduced into the dryer, until such time that this wetter or drier grain reached the point of the monitoring sensor. There is, therefore, a need for equipment of this type which will adequately compensate for this situation of having grain of variable moisture entering the dryer.

SUMMARY OF THE INVENTION

The present invention relates to a grain drying and conditioning apparatus having a housing with an outer impervious skin with air inlet, grain inlet, grain outlet and air exhaust structures connected thereto. Spaced air pervious walls are disposed within the housing and skin for confining a column of grain to be dried and for forming a column of air between the outermost impervious skin and the outermost pervious grain confining wall. A blower and burner mechanism is also connected to the housing for causing heated air to be forced through a first zone of the column of grain in one direction to heat and extract moisture therefrom and simultaneously causing air for cooling the grain to be pulled through the air inlet structure and through a second zone of the grain column in an opposite direction to the flow of the heated air. A plenum chamber is formed between the innermost of the pervious walls and the blower and the air duct structure and an adjustable plenum divider mechanism is provided between the innermost of the walls and the blower and air duct structure in the plenum chamber for selectively adjusting the relative extent of the zones and for dividing the plenum chamber into a first and a second section for the purpose of optimizing the heating and cooling of the grain in the first and second zones.

A first temperature sensing thermocouple is disposed in the first section of the grain or air column and is spaced vertically closer to the grain inlet structure than to the plenum divider. A second temperature sensing thermocouple is disposed in the first section of the grain or air column and is spaced vertically closer to the plenum divider than to the grain inlet structure. These first and second temperature sensing thermocouples are connected in parallel such that the outputs of the thermocouples are averaged into an average output signal. Structure is also provided for operating in response to such averaged output signal for controlling a metering structure to thereby control the flow of grain through the grain drying apparatus in response to such averaged output signal whereby a signal corresponding to a lower than desired averaged temperature signal will cause less grain to pass through the metering structure and a signal corresponding to a higher than desired averaged temperature signal will automatically cause more grain to pass through the metering structure and thereby through the dryer.

Air recycling structure is provided for blending unsaturated exhaust heated air which has gone through the grain with incoming cooling air for saving the energy in such heated air. A grain turning apparatus is also used in combination with the structures mentioned above in this section for diverting the outermost and wetter grain to the inside and inner drier grain to the outside as the grain passes through the first or drying section of the grain dryer to thereby facilitate even drying the grain in such grain column, and improving drying efficiency significantly by not overdrying to reach a desired "average" final moisture level.

An object of the present invention is to provide an improved grain drying apparatus.

Another object of the invention is to control the cooling capacity of the dryer while devoting all remaining energy towards increasing the drying capacity and efficiency of the drying apparatus.

A further object of the invention is to provide a grain drying apparatus having a plenum chamber for dividing the grain therein into drying and cooling sections whereby the plenum divider is adjustable in position to vary the relative amounts of grain in each zone and the plenum air volume in each zone to achieve optimum use of the available blower airflow capacity.

Still another object of the invention is to provide an apparatus for compensating for variations in the moisture content of grain being introduced into such grain dryer.

A still further object of the invention is to provide a grain turning device which is located in a grain drying column for transferring the warmest grain from the inside of the column to the outside and the cooler, wetter grain from the outside of the column to the inside for reducing heating and cooling stresses and reducing the moisture difference between kernels of grain being dried.

Another object of the invention is to recapture a portion of the drier exhaust heated air and return it to the blower for blending with cooling air and free ambient air to reduce the fuel consumption of the device while drying grain thus providing a dryer of significantly higher efficiency than prior art drying systems.

Other objects, advantages and novel features of the present invention will become apparent from the following detailed description of the invention when considered in conjunction with the accompanying drawings.

DESCRIPTION OF THE PREFERRED EMBODIMENT

Figure 1:
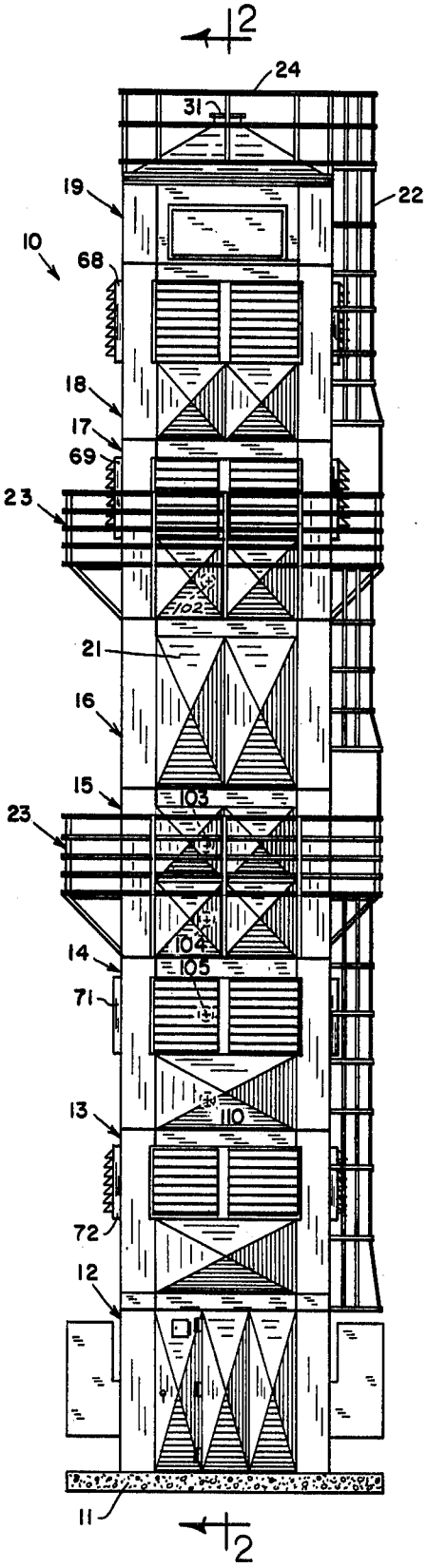
FIG. 1 is a side elevational view of the drying apparatus of the present invention.

Referring now to the drawings wherein like reference numerals designate identical or corresponding parts throughout the several views, FIG. 1 shows a preferred embodiment 10 attached at the bottom thereof to concrete base 11. The grain drying and conditioning apparatus shown in FIG. 1 has eight sections including a base section 12, intermediate sections 13–18 and a top section 19.

The framework of the invention has an outer skin 21 attached thereto on sections 13–19. Also connected to the framework is a ladder 22 including a safety cage. Service platforms 23 are also connected to the framework. A railing 24 on top of the grain drying and conditioning apparatus 10 is provided for allowing safe access to this top portion of the device.

Figure 2:
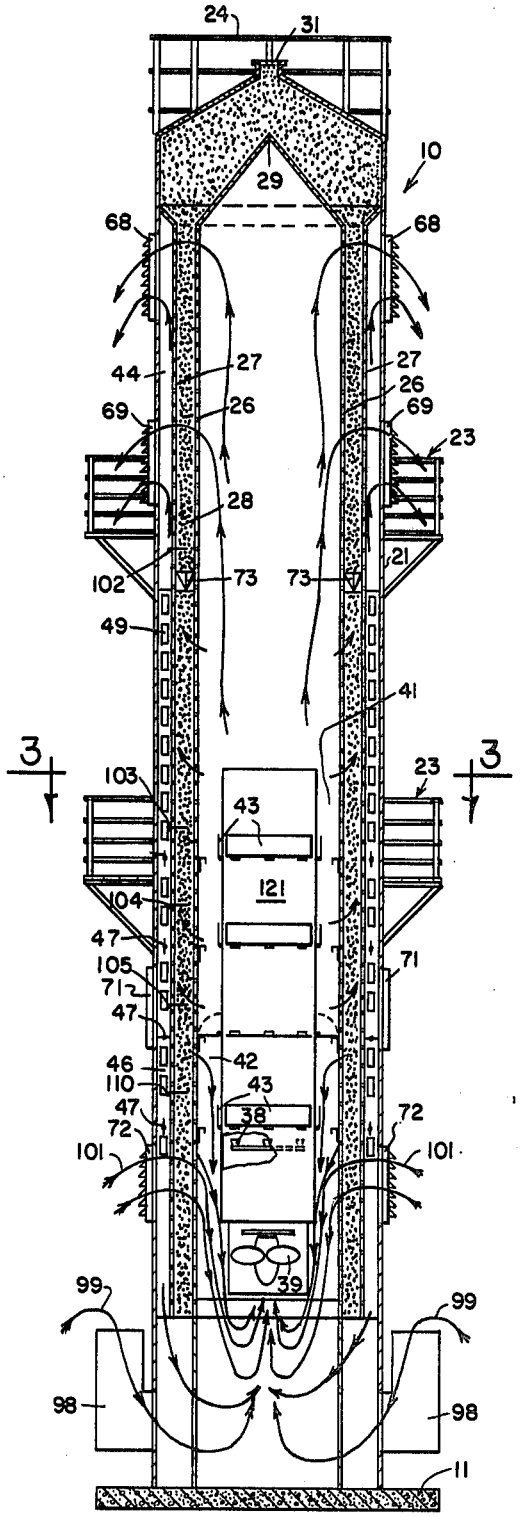
FIG. 2 is a cross-sectional view of the present invention taken along line 2—2 of FIG. 1.

Referring now more specifically to FIG. 2, it is noted that a pair of air pervious walls 26 and 27 are disposed on each side of the device for confining the grain 28 therein. The tops of the walls 26 converge together to a point 29 so as to funnel the grain downwardly into the grain column 28 containing the grain being dried. A grain inlet 31 is provided in the top section 19 for introducing grain to be dried and conditioned so that it can flow by gravity through the device 10. Grain metering rolls 32 are provided as the bottom of each grain column 28 in the base section 12 for controlling the amount of grain which is allowed to flow out into grain collecting hopper 33 (FIGS. 8–10) which lead to gravity flow grain chutes 34 (FIGS. 8 and 9) to the discharge point 36, which can have an auxiliary unloading conveyor 37 attached thereto.

A burner 38 for heating blower air flow is best shown in FIG. 2 and is mounted downstream from a blower fan 39 used for forcing air upwardly through the burner 38. A plenum chamber is thereby formed between the air duct 121 and the inner pervious grain holding wall 26 and this plenum chamber is divided into an upper plenum chamber 41 and a lower plenum chamber section 42 by means of an adjustable plenum divider structure including doors 43 which are pivotally mounted to the air duct walls 121. One level of the plenum divider is always closed and the other plenum divider doors are always open.

Still referring to FIG. 2, it is noted that an air column is formed between the outer skin 21 and the outermost pervious wall 27. This air column is also divided into a first section 44 and a second section 46. The dividing line between the air column sections 44 and 46 is whichever of the butterfly blocking valves 47 which are closed. In actual practice, the butterfly blocking valves 47 which are at the same chosen level as the plenum divider doors 43 which are closed, is the dividing line, since the butterfly valves 47 at the other levels would be open.

Figure 5:
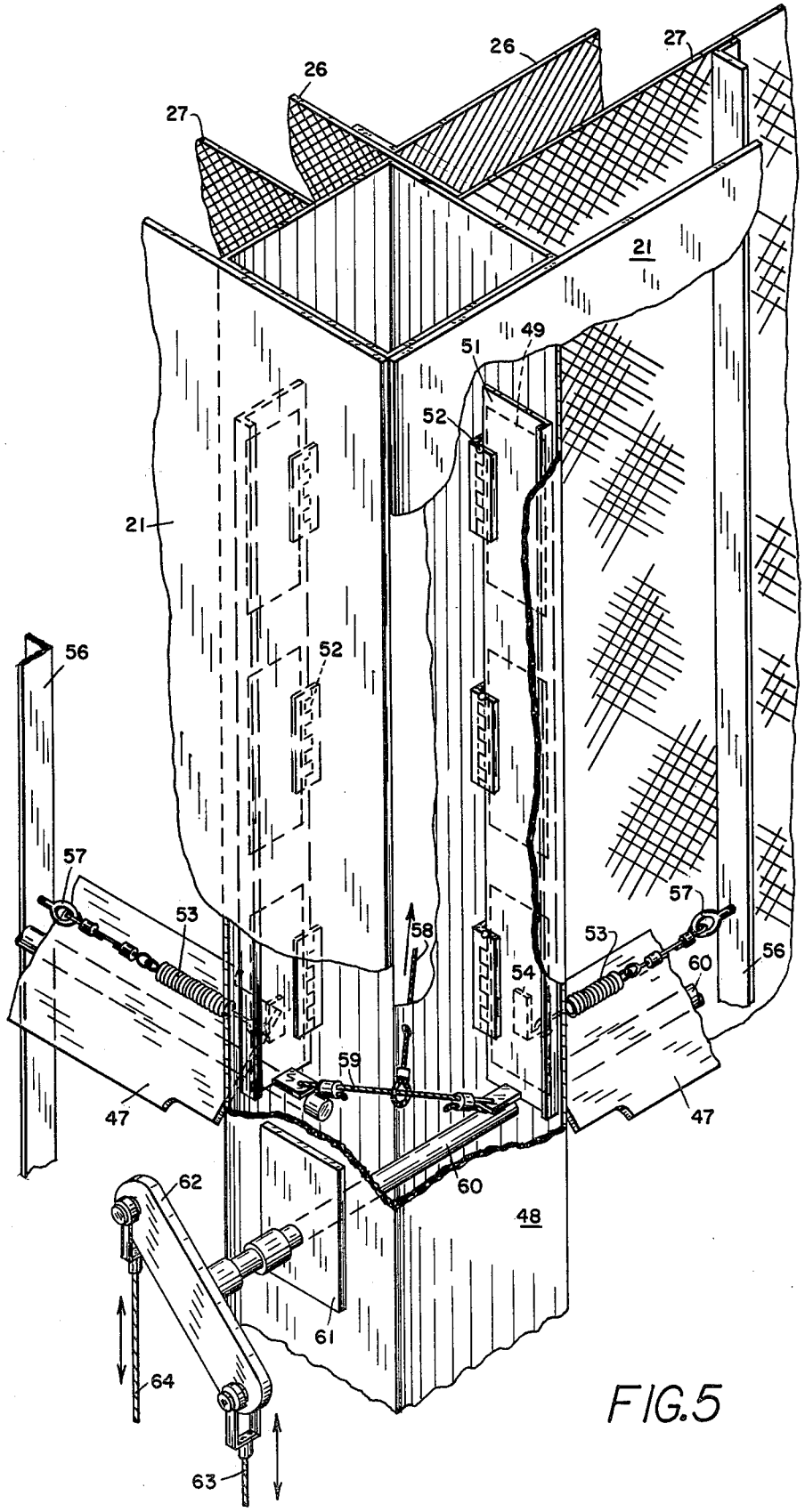
FIG. 5 is a perspective view of a corner section of the present invention with a portion thereof broken away to show airflow blocking butterfly valves, doors leading to such corner sections and the structures for actuating these mechanisms.

Referring to FIGS. 5 and 2, for example, it is noted that on each corner of the device there is a corner column structure 48 and that this corner column structure 48 has a plurality of openings 49 therein.

Figure 7:
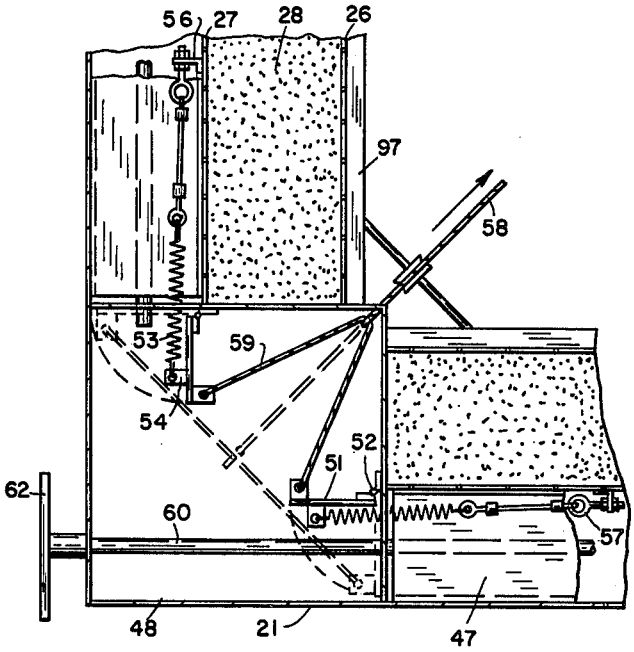
FIG. 7 is a cross-sectional view of the corner columns taken along line 8—8 of FIG. 5.

These openings 49 are selectively opened or closed by means of doors 51 which are hingedly attached to the inside of the corner column by hinges 52 and are biased to a closed position by means of a tension spring 53 which is in turn, attached at one end thereof to the door 51 by a bracket 54 and at the other end to a structural frame member 56 through a turnbuckle arrangement 57 within the air column comprised of sections 44 and 46. These doors 51 are normally held closed to the position shown in FIG. 5 and they can be opened by pulling on the cable 58 which pivots the doors open, as can best be seen in FIG. 7. The cable 58 which leads into the air duct of the grain drying apparatus 10 is then secured in order to hold these doors in an open position, overcoming the bias of the springs 53. Once the cable 58 is released, the doors 51 will, of course, return to the closed position.

Figure 6:
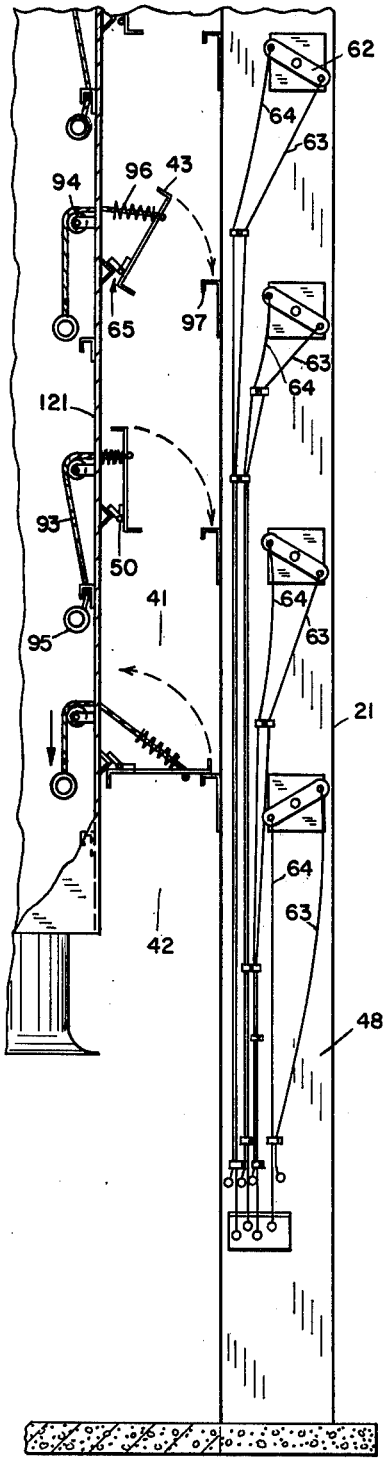
FIG. 6 is a partial cutaway side elevational view of the present invention showing the actuating mechanisms for the plenum divider and the blocking butterfly valves in the air column between the grain column and the outside skin of the dryer.

Also shown in FIG. 5 is the mechanism for opening or closing the blocking butterfly valves 47 at a particular level. A shaft 60 is rigidly attached to one of the butterfly valves 47 and is rotatably mounted by means of a bearing plate 61 in the corner column 48. A lever 62 is rigidly attached to the end of the shaft 60 so that pulling downwardly on the cable 63 attached to the lever 62 causes the valve 47 to be open, and pulling downwardly on the cable 64 attached to the lever 62 causes the valve 47 to be closed. The other butterfly valves 47 at the same level can be operated in a similar fashion. FIG. 6 shows the external mounting of levers 62 at design levels with cables mounted so as to secure the lever 62 and butterfly valve 47 in a closed position as shown by example on the lowest unit or in an open position as those levels above said lowest position. Adjacent plenum divider door 43 at the lowest level is closed while other plenum divider doors above said lowest doors are latched open.

Figure 12:
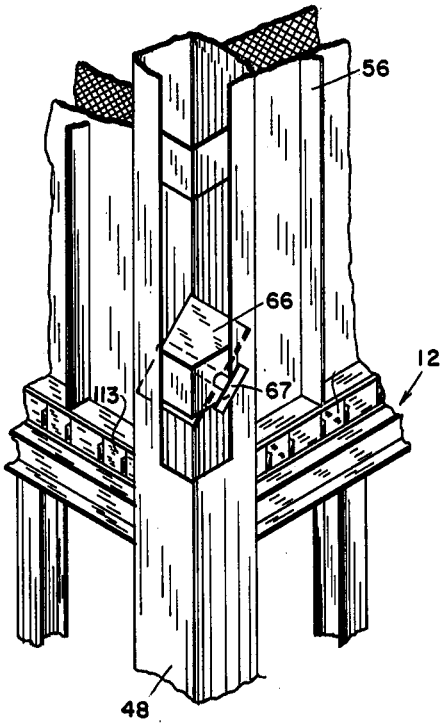
FIG. 12 is a partial perspective view of a corner of the grain drying apparatus showing the upper part of the base and the lower part of the corner column.

Referring now to FIG. 12, it can be seen that the corner column 48 has a corner column air recycling cutoff valve 66 therein which is selectively operable by turning the lever 67 to either open or close it. FIG. 2 shows a plurality of louver structures 68, 69, 71 and 72 also connected to the outer skin 21 and selectively communicates the outside air with the inner air column.

Figure 11:
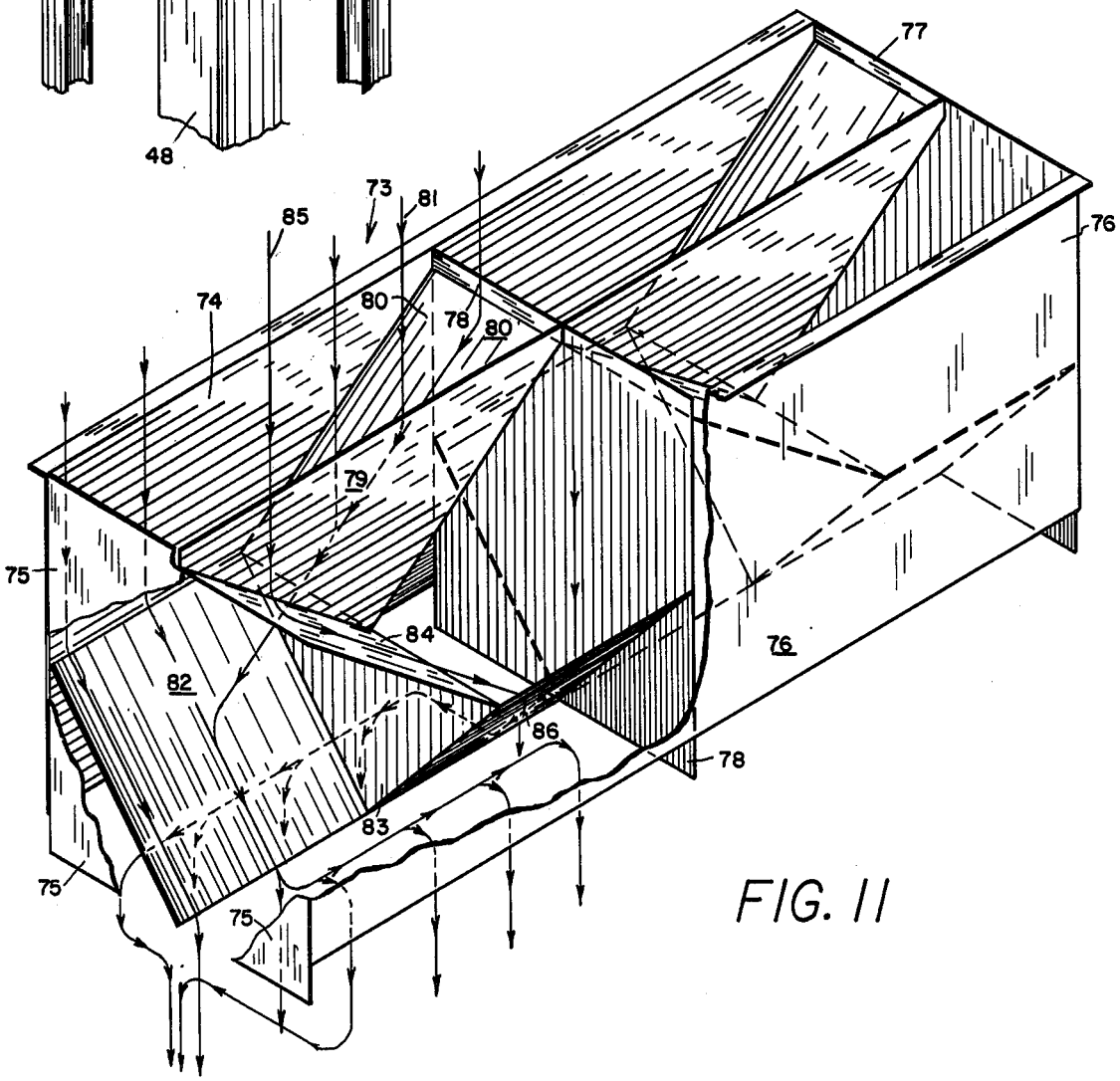
FIG. 11 shows a detailed perspective view of the grain turning apparatus shown schematically in FIG. 2.

Referring now to FIGS. 2 and 11, it is noted that a grain turning apparatus 73 is preferably disposed in each of the grain columns 28 between the walls 26 and 27 across such grain column 28 at an approximately midpoint (but not limited to a given level or number of positions) of the normal upper drying column of the grain subjected to heat and above the openings 49 in the corner columns 48. These grain turning devices 73 are for the purpose of causing the grain flowing downwardly therethrough which is near the outermost wall 27 to be diverted inwardly towards the innermost wall 26, and the grain which is near the innermost wall 26 above the grain turn 73 to be diverted outwardly towards the outermost wall 27 as the grain passes through the grain turning apparatus 73.

Looking specifically to FIG. 11, it is noted that the device is constructed primarily of a plurality of outer flat walls 74, 75, 76 and 77 and an inner flat wall 78. A slanted wall 80 is attached at the top thereof to the wall 78 and along one edge thereof to the wall 74. It is connected at the other end to a flat vertical triangular-shaped wall 79 which divides the grain into inner and outer separately moving masses. As the grain moves downwardly as shown by the arrow 81 in FIG. 11, it follows the top surface of the slanting wall 80 and then it drops off onto a slanted wall 82 which is connected to wall 74, 75 and 83 turning 90 degrees in direction. This movement causes the grain to accelerate as it moves through the opening beneath slanted walls 84 and 86 and rotates through another 90 degree turn and spreads out between walls 75 and 78. Diagonally opposite on the other side of the device 73 is a similar slanted wall structure 84 which is like a mirror image of the member 80 on the other side of turn 73, and this member 84 is attached to the wall 75 and 76 and at the bottom to the triangular plate 83. Grain moving downwardly between the members 75 and 78 over and down the surface 84 would then generally follow the arrow 85 and the slanted plate 86 which is connected to the triangular plate 83 and wall 78. The structure between the plate 77 and 78 is substantially identical to the grain turning apparatus just described on the left most side of the grain turning apparatus 73, as seen in FIG. 11. Once the separated grain masses, following individually arrows 81 and 85, have rotated 180 degrees and spread from walls 75 to 78 on opposite sides from where they contact slanted walls 80 and 84, the two masses rejoin, continuing downwardly.

Figure 13:
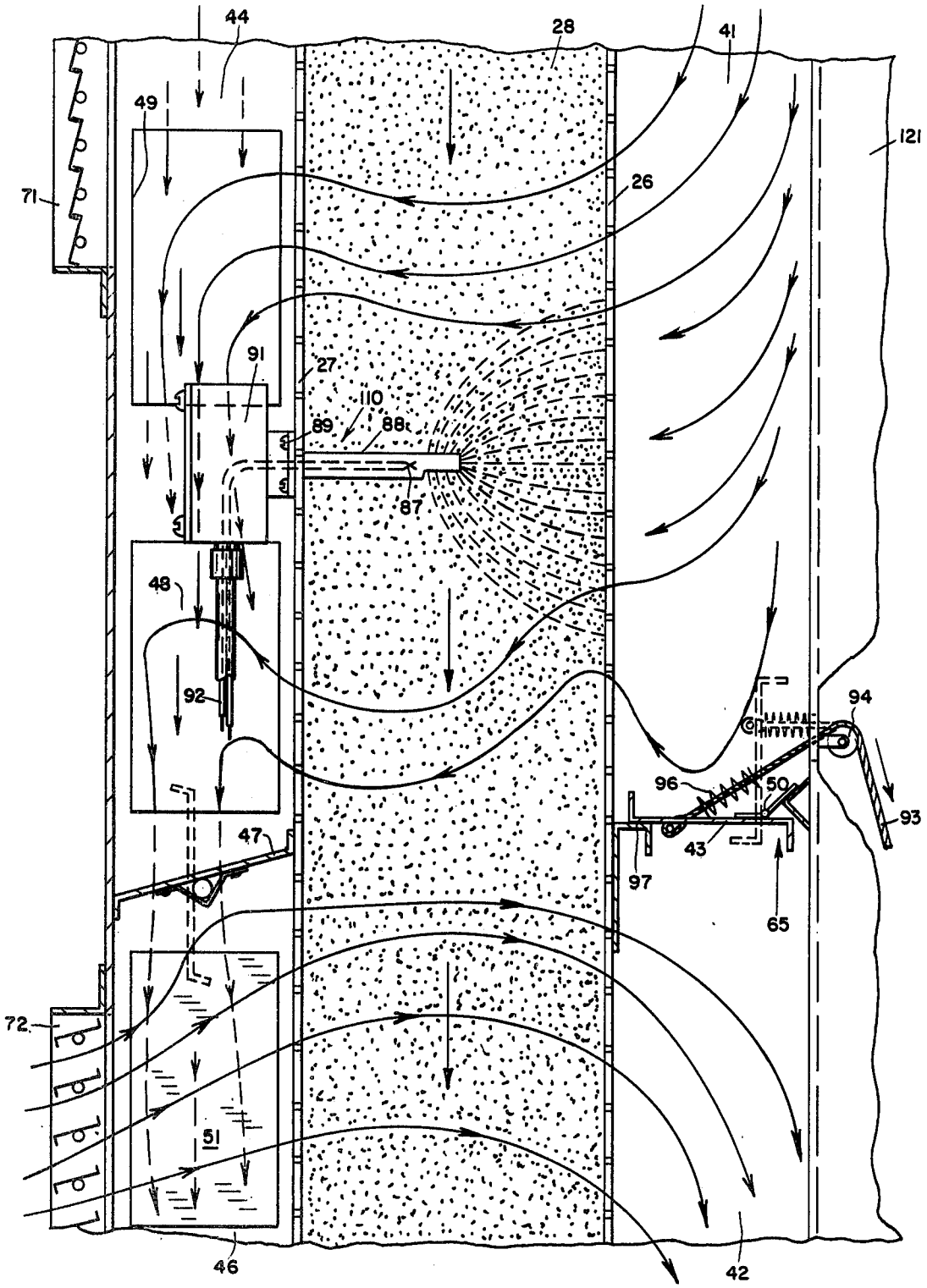
FIG. 13 is an enlarged cross-sectional view similar to FIG. 2 but showing the detail of the grain temperature sensing devices, blocking butterfly valves, plenum door divider structure, the corner columns and the air flow associated with this structure when the dryer is in operation.

Turning now to FIG. 13, it is noted that an automatic moisture control sensor 87 is disposed within an automatic moisture control shield 88, and that this structure is connected by bolt structures 89 to the outermost pervious wall 27 such that the sensor 87 is disposed within the grain column 28. This sensor could alternatively be placed entirely in the air columns 44 at the desired level. A housing box for such structure is shown at 91 and a thermocouple wire 92 leads to a central control box (not shown) which will be discussed below.

Figure 3:
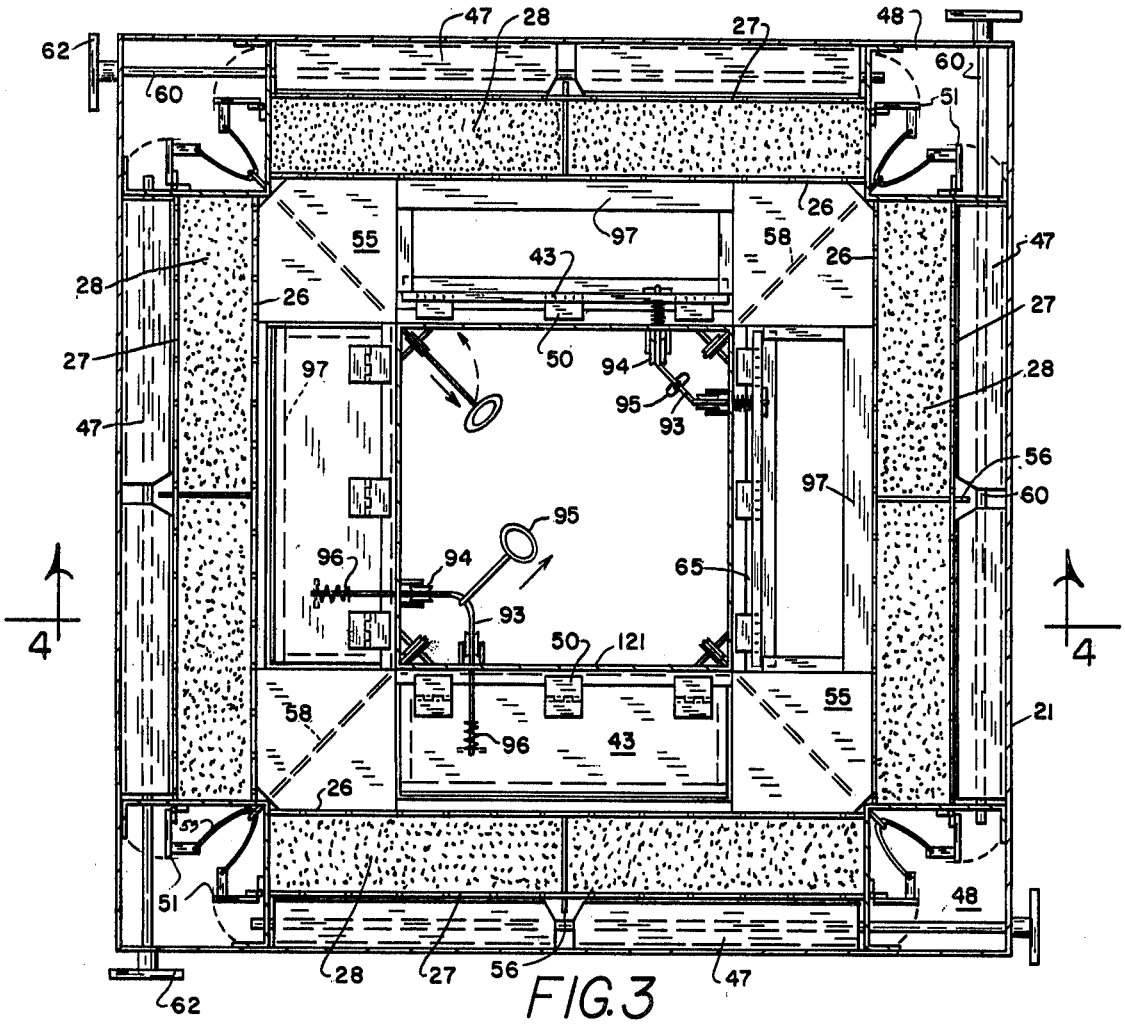
FIG. 3 is a cross-sectional view of the present invention taken along line 3—3 of FIG. 2.
Figure 4:
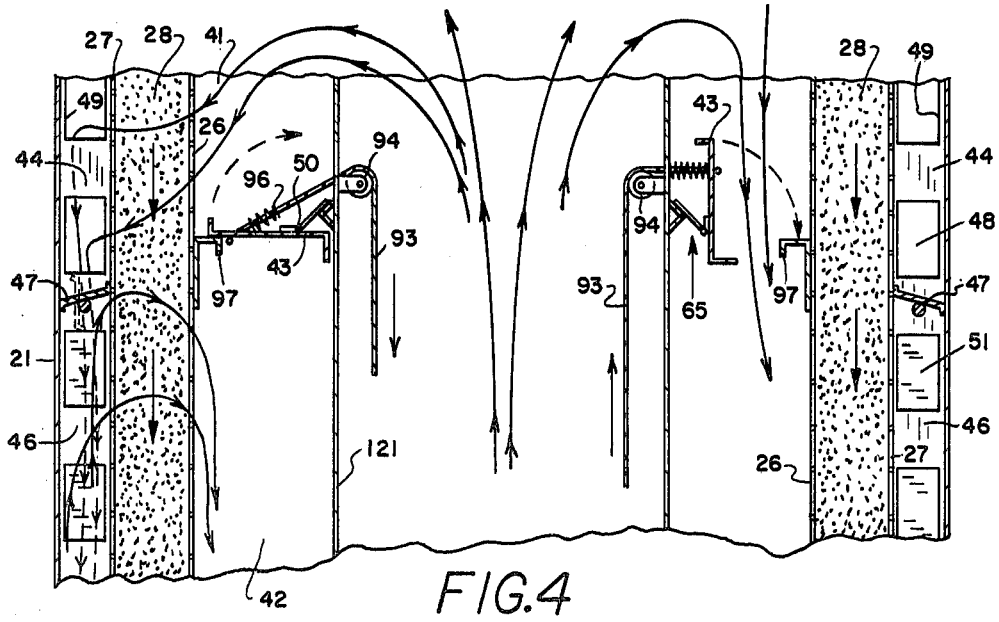
FIG. 4 is a partial enlarged view taken along line 4—4 of FIG. 3 and showing the adjustable plenum doors in detail.

Also shown in FIG. 13 is the control structure for one of the plenum divider doors 43. The plenum divider door 43 (see also FIGS. 3 and 4) is pivotally attached by a hinge structure 50 to the air duct structure 121. The actuating structure of the door can be constructed in varius fashions, but the preferred form is shown in FIG. 13 and includes a cable 93 which goes over a pulley 94 attached to the air duct 121 and when the cable 93 is pulled, the plenum door 43 will move from the closed position as shown in FIG. 13 to the opened position shown in dashed lines in FIG. 13. The cable 93 is then secured in that position to prevent the door from being closed until it is desired to close such door. A compression spring 96 is disposed around the end of the cable 93 so that when the cable 93 is pulled downwardly and the door moves to the position shown in dashed lines in FIG. 13, the compression spring 96 will be compressed somewhat as in dashed lines in FIG. 13. Consequently, when the cable 93 is released so as to close the plenum divider door 43, the compression spring 96 will push the door 43 outwardly from the air duct wall 121 and then gravity will cause the plenum door 43 to continue downwardly to the closed position as shown in solid lines in FIG. 13, whereby it rests on the stop member 97, rigidly attached to the inner wall 26 of the grain column 28. The other plenum doors and actuating structures therefor are substantially identical to that shown in FIG. 13. Referring specifically to FIG. 3, it is noted that at each plenum level there are four corner seals 55 rigidly attached to the air duct 121 and to the corner columns 48. These corner seals 55 are provided for completing the blocking function for dividing the plenum chamber into two sections at one of a plurality of selected levels when desired. When the plenum doors 43 are open, grain dust can be swept off of these seals 55 manually. Another important housekeeping feature can be seen by reference to FIGS. 3 and 4. It is noted that a space 65 is provided between hinges 50, air duct 121 and doors 43 such that when the doors 43 are in the upward position that foreign material which would gather on top of the door 43 would drop down to the base of the dryer 10 through openings 65. When the doors 43 are closed, this space 65 is also automatically closed.

In operation, and referring specifically to the operating position shown in FIG. 2, it is noted that the plenum doors 43 are closed at one level and that the blocking butterfly valves 47 are also closed at that same level with the other plenum doors 43 and other butterfly valves 47 at the other levels being in the open position. Grain to be dried and conditioned is then delivered into the opening 31 and such grain travels downwardly through the grain column until such grain column 28 is full from a point adjacent the metering rools 32 (FIG. 10) to the very top 31. The blower 39 is then turned on and the burner 38 ignites automatically. In this particular preferred embodiment, the burner 38 maintains a constant heated air temperature in the plenum 41 and the blower 39 delivers a constant volume of air. The louver structures 68, 69 and 72 would be open, and the louver structure 71 would be closed. (Louver structure 71 would normally be open for cooling air when the plenum divider level is above the structure 71 and could be open to exhaust heating air when the plenum divider level is below it, if recycling of the lower exhaust heated air was not desired.) The initial start up of the grain drying apparatus can be achieved in several ways and one way would be to merely recycle the grain coming out of such grain dryer until a steady grain moisture-temperature condition is sensed. For example, when the dryer is initially filled with wet grain, the lower portion thereof (below the plenum divider) will not be subjected to enough heat so that the grain would not dry adequately. But once the upper grain above the plenum divider is dried, and the grain in the column 28 below the plenum divider 43 is cooled, then such grain can begin to be delivered to storage facilities and grain can constantly enter the top 31 and constantly exit the bottom of the grain drying device 10.

Once the dryer is operating continuously; that is, when the metering rolls 32 (or other suitable metering apparatus) are rotating to constantly remove grain from the bottom of the grain column 28, the grain going down the grain column 28 will constantly have heated air passing therethrough at the top thereof because of the pressure built up in the top portion of the plenum chamber 41, that is above the closed plenum doors 43. This air passes through the pervious walls 26, the grain 28, and the other pervious walls 27, through the air column 44 formed between the wall 27 and the skin 21, and out through the louvers above the plenum divider which are open, for example the louvers 68 and 69. At the same time, air will be drawn in through free air inlets 98 as indicated by arrows 99. At the same time, if it is desired to cool the grain before it is sent to storage, which is almost always desired, then the grain cooling air louvers 72 are opened such that air from the outside can enter the lower part of the plenum chamber 42 as indicated by the arrows 101.

At the same time that the plenum divider door level 43 is chosen and the butterfly valves 47 corresponding to such level are closed, the doors 51 which are above such plenum divider level are opened (FIG. 7) and the doors 51 which are below the chosen plenum divider level are held closed by spring 53.

If the heated air which is going through the grain at the upper levels of the grain column 28, for example at the level of the louvers 68, the air is quite often completely saturated with moisture as it leaves the grain, but the air in the air column 44 at lower levels is quite often warm but not completely saturated. Consequently, it is usually desirable to recirculate this warm and unsaturated air back to the blower as a means of saving drying energy. To recirculate exhaust heated air, the butterfly valve 66 at the bottom of the corner sections 48 are open. When such recirculation is not desired, then these butterfly valves 66 are closed. The actual path of such recirculated air can be seen most readily by looking together at FIGS. 2, 10 and 13. The air which is recirculated would be entering the column 44 at a point below the grain turns 73 and would enter the openings 49 in each of the corner columns, FIG. 2. The air would then go down the corner columns and past the open butterfly valve 66 at the bottom of the open corner columns and back into the base section 12 where it would then be recirculated back up through the blower 39, burner 38 and air duct 121 into the heat plenum 41.

Figure 14:
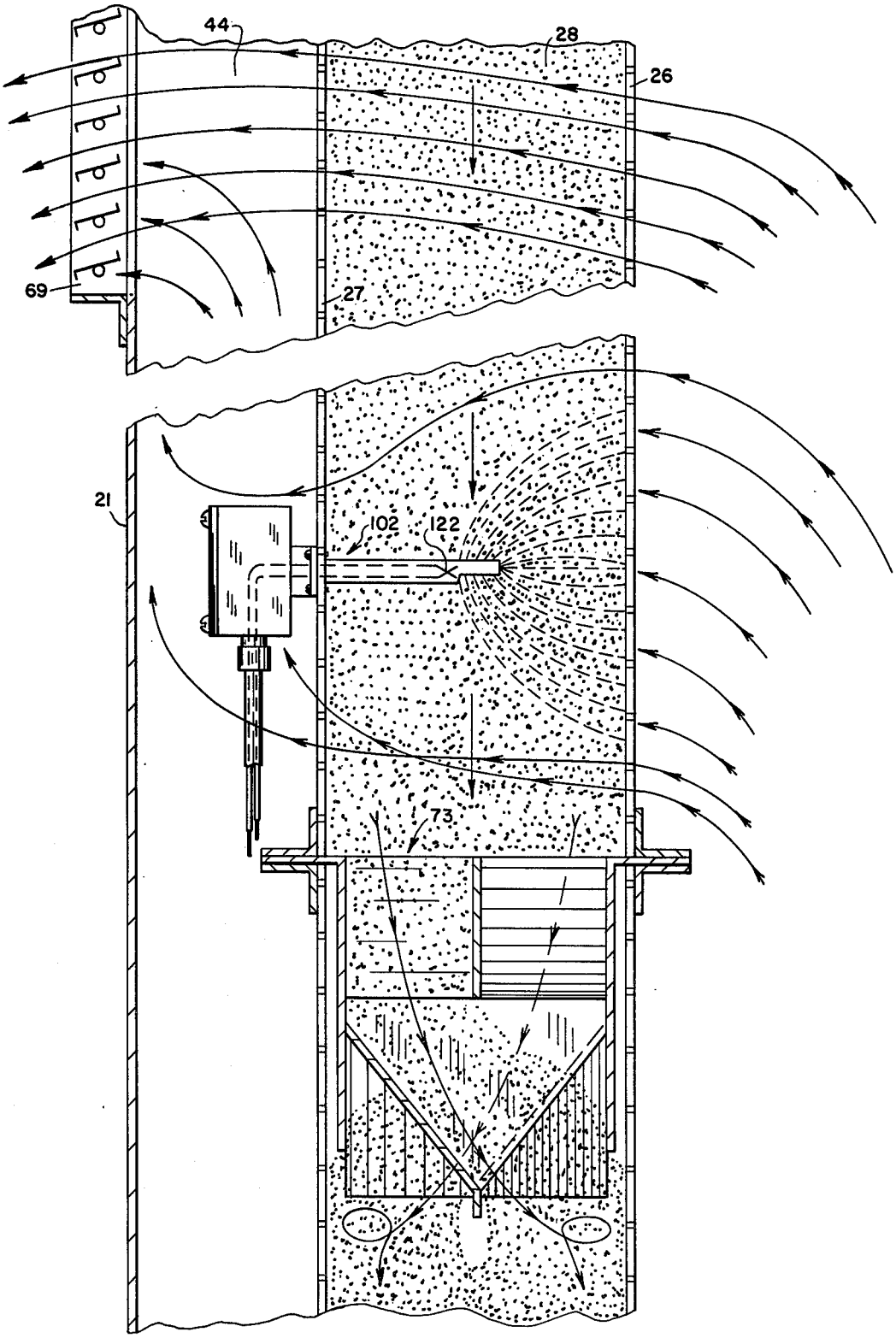
FIG. 14 is an enlarged, cross-sectional view similar to FIG. 13, showing the detail of the grain temperature sensing device used for "averaging", and its relative position to the grain turn structure, moist exhaust air structure, and hot plenum air and moist exhaust air flow patterns.
Figure 15:
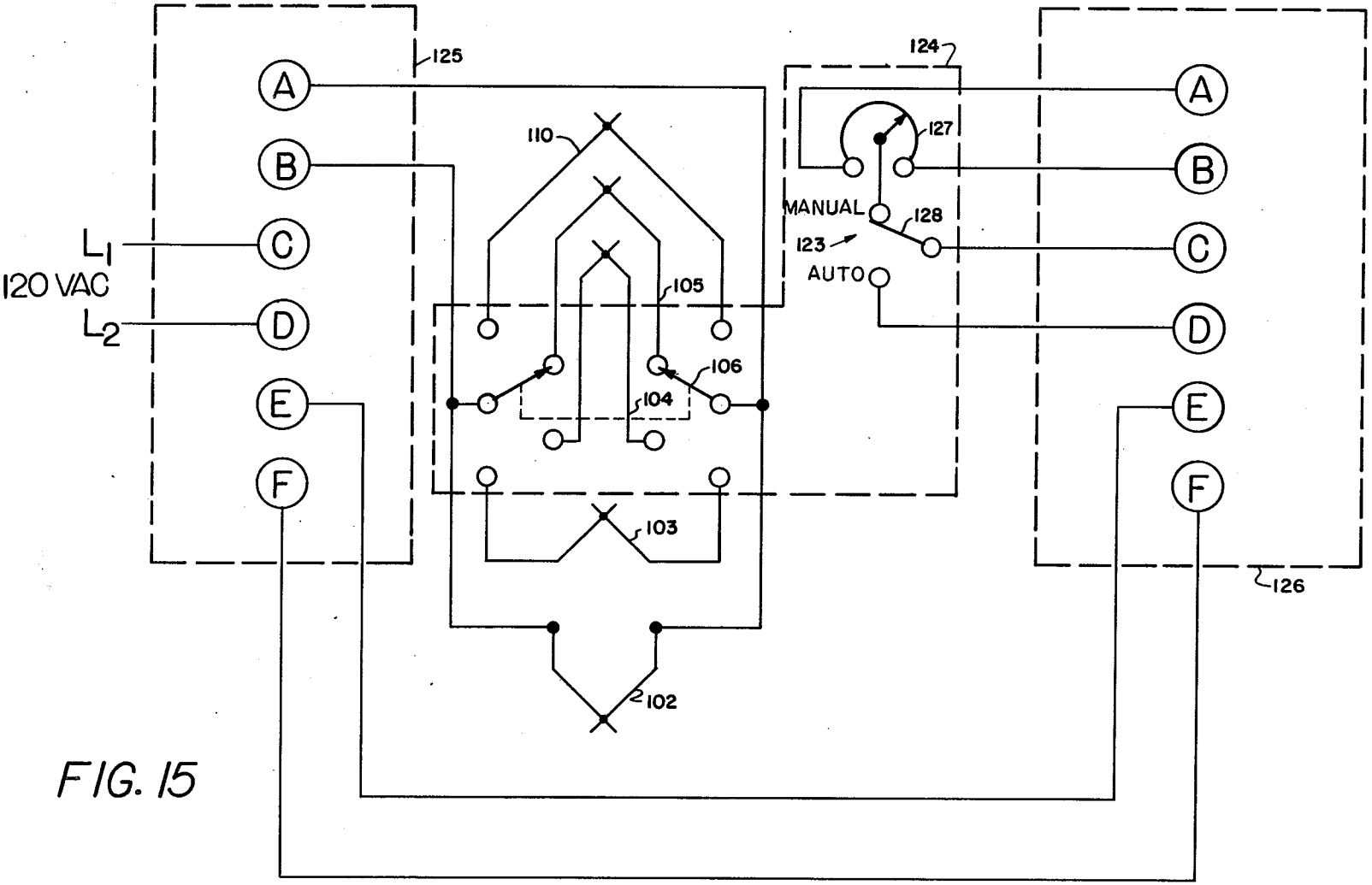
FIG. 15 illustrates a simplified form of a circuit used for controlling the flow of grain to the grain dryer in response to a sensing of averaged temperature conditions in the column of grain being dried.
Figure 16:
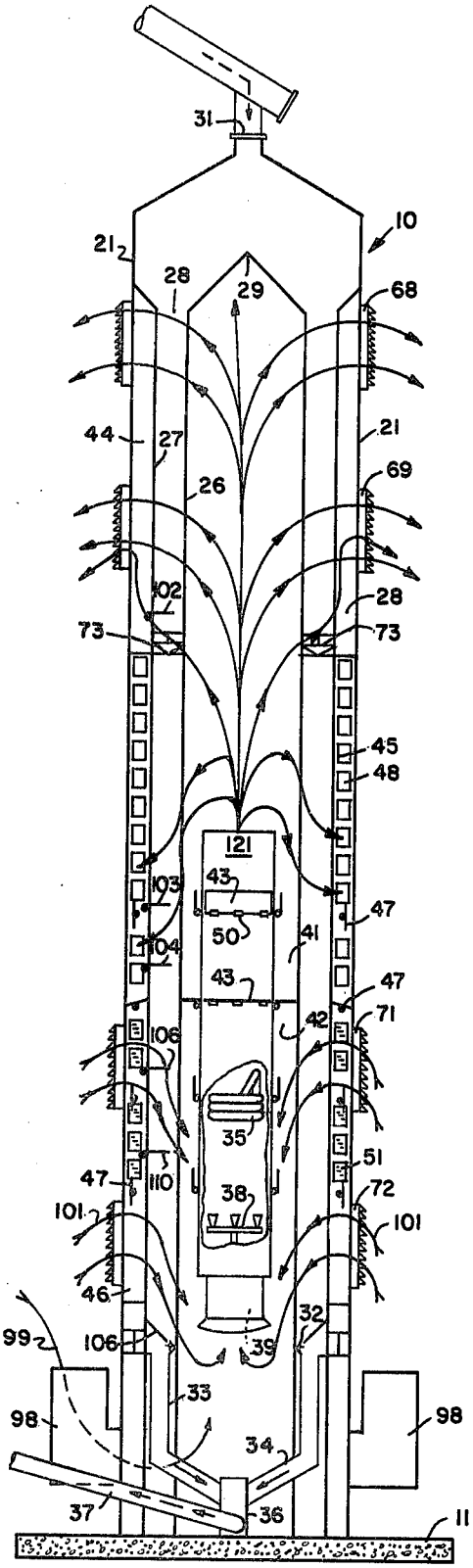
FIG. 16 is a cross-sectional view like FIG. 2, but showing a different mode of operation including a different plenum level in use.

The circuit in FIG. 15 is important because it regulates the rotation of the metering rolls 32 and thereby the output of the grain dryer. This circuit is connected to a series of probes like that shown in FIGS. 1, 2, 13 and 14. A first averaging probe 102 is disposed just below the louvers 69, FIG. 2 and FIG. 14. The averaging thermocouple 122 senses the temperature of the air passing through the grain and exiting the grain column 28 at the level, and it produces a millivolt output signal proportional to such temperature. This probe 102 is termed an "averaging" probe for reasons which will become apparent below. A plurality of other probes 103, 104, 105 and 110 are disposed directly above each of the plenum divider doors 43. These sensors 103, 104, 105, and 110 also are used to sense the temperature of the exhaust drying air exiting the grain at each respective level. These probes 103, 104, 105 and 110 are substantially identical to the probe 102 as shown in FIG. 14. A selector switch 106 (FIG. 15) is used to place the averaging thermocouple sensor 122 in parallel with whichever plenum sensor is directly above the plenum doors 43 which are closed.

When the doors 43 are in the position shown in FIG. 2, then the plenum sensor probe 105 would be the sensor in use. The output of these two probes, for example thermocouples 122 and the one in probe 105, are used as an output signal to control the operation of the metering rolls 32. In other words, this signal indicates the average condition of moisture and speed of drying of the grain in the top drying zone above the plenum dividers 43 which are closed. For example, if wetter than normal grain were to suddenly be introduced through the opening 31, once this grain reached the level of the probe 102 a constant amount of heated air going through the wetter grain would cause more than normal evaporative cooling to occur and the thermocouple probe 102 would sense this colder condition. The output of this condition sensed would be averaged with the output of the thermocouple in probe 105 and the resultant signal would cause the metering roll 32 to gradually slow down (the rate of increase or decrease in response can be adjusted) so that the wetter grain entering will be certain to be dried adequately by the time that it gets to the bottom of the dryer 10. If the averaging probe 102 was not present, this condition would not be sensed until the wetter grain got to the probe 105, at which time the west grain would enter the cooling chamber in a condition where it is not dry enough to be stored safely. Should the grain entering the dryer be drier than the grain which had just previously entered the dryer, then this condition would be sensed by the probe 102 because a higher temperature would be sensed (less evaporative cooling would be occuring at that point) and this signal would, when averaged with the probe 105, cause the metering roll 32 (FIG. 10) to gradually increase in speed and thereby cause such grain to pass through the dryer more rapidly since it would need less heat to be dried.

The reason that the sensor just above the closed plenum level is used is to use the largest time lag range possible for the averaging of the temperatures. The "early history" of the grain being dried is indicated by sensor 102 and the "late history" of the grain being dried is indicated by whichever lower sensor is being used.

Conventional cross flow continuous dryers control grain flow meter speed by sensing the grain moisture or temperature at a single level or point at or near the plenum divider. However, to gain optimum control over the grain in the complete drying zone, a continuous representative moisture evaluation sampling of the entire drying zone has to be obtained. Because of the ability to combine or blend the millivolt signals generated by thermocouples into one average signal value by connecting the thermocouples in parallel, thermocouples at vertical elevations are used giving optimum control of the metering drive in this invention. Using two or more thermocouples (or other types of sensors such as electrical resistance or capacitance sensors that can be parallel connected to yield an average output signal) at specifically spaced vertical elevations, a complete grain moisture "signature" or "history" is monitored and translated into automatic variable speed control through the temperature controller. Controller response is set for a gradual and steady change in output signal; it is set so that a specific increment of metering speed change as a percent of maximum meter speed is allowed, and without extreme final moisture deviations or fluctuations. It is to be understood that sensors other than thermocouples, such as resistance or capacitance sensors, capable of developing an average or blended control signal that can be directly related to grain moisture content can be used. For example, even two or more humidistat controls may be capable of being interfaced electronically to give a multiple level control and used instead of thermocouples.

The significant advantage of the multiple sensing level control of grain flow is that it provides a means of uniformly controlling the drying of the grain mass between the initial and final sensing levels without sudden and erratic grain flow rate fluctuations that occur in systems using signal point sensing control.

Once all conveyors are either running or set to run automatically, the dryer has been filled, and the blower and burner are on, the manual/auto selector switch 123, part of the automatic moisture control panel 124, FIG. 15, is set on "Manual" and the metering drive motor turned on, energizing the variable speed metering drive power panel 126. The temperature controller 125, FIG. 15, has previously been powered on wires $L_1$ and $L_2$ connected to temperature controller terminals Ⓒ and Ⓓ.

The power panel 126 provides voltage across the manual speed potentiometer 127 through power panel terminals Ⓐ and Ⓑ FIG. 15, to the variable speed metering drive motor (not shown) connected to metering rolls 32. Depending on control dial setting, 0 to 100 percent of voltage potential is sent through the power panel 126 where the voltage signal is amplified appropriately to control the metering drive motor speed.

After the meters 32 are started and the dryer has reached a steady-state grain drying flow rate on manual control, the thermocouple sensor level selector switch 106 has been set to the thermocouple position directly above the plenum divider level, and the controller dial (not shown) has been set at a temperature setting that centers the controller needle, the manual/auto selector switch 128 is turned to the "automatic" control mode; with the controller needle centered, the metering drive motor speed is the same after switching as immediately before. A continuous control signal now flows from the temperature controller terminals Ⓔ and Ⓕ to the power panel terminals Ⓔ and Ⓕ this signal strength varies based on the thermocouple millivolt signals received by the controller 125, which precisely controls a variable continuous amplified power voltage through power panel terminals Ⓒ and Ⓓ.

The temperature controller 125 receives a continuous millivolt signal on terminals Ⓐ and Ⓑ from thermocouples that are positioned in tubes that project perpendicularly through the perforated grain panel wall from the exterior toward the interior, a known distance into the grain column, FIGS. 13 and 14. This millivolt signal generated by the thermocouple(s) is a precisely predictable value based on the temperature of the exhaust drying air passing over the thermocouple.

The temperature of the air drops as it absorbs moisture while it passes through a portion of the grain thickness and enters the opening in the tube. The temperature of the discharge air from the grain surrounding the thermocouples is proportional to grain moisture content, (wetter grain causes cooler discharge air), thus, giving a precise indication of the grain moisture level as the grain leaves the drying zone.

The "averaging" probe 102 (FIGS. 14 and 15) thermocouple 122 (FIG. 14) is located directly above the grain turn 73, FIG. 14, inside a tubular grain shield. (In FIG. 15, the probe numerals are given rather than the thermocouple numbers, since certain of the probes do not have thermocuple numbers given in the drawings. Alternatively multiplicity of sensors in vertical columns and horizontal rows can be used.) The air takes the path of least resistance or lowest pressure drop, thus, flowing into an opening at the end of the tube as a series of "funnel" or "bowl" shaped paths that routes the air through a grain depth of approximately half of the column thickness while following variable length paths with the shortest being a straight in line path and the longest being a curved path slightly shorter than the maximum grain column width, the longest path forming the outside of the "funnel" or "bowl" shape pattern of air flow.

The averaging thermocouple 102 sensed the temperature of the air (which is directly related to the initial and final moisture content of a specific mass of grain) early in the drying zone, but far enough down the grain column to obtain a stable and significant temperature rise with respect to levels higher up where the grain is wetter. This air is considerably cooler than the heat plenum temperature due to adiabatic or evaporative cooling of the air as it absorbs moisture from the grain. This thermocouple 102 (or vertically and/or horizontally aligned multiplicity thereof) provides the "early history" of the grain mass passing that level (or levels) at any given time.

The lower thermocouple (or multiplicity thereof) that is selected directly above the previously selected plenum divider level senses the temperature of drying air passing through the grain just before it leaves the drying zone generating a continuous "late history" control signal output; this air is warmer than the "averaging" sensor temperature signal coming from farther up the grain column, as the adiabatic cooling process has slowed down since less moisture is absorbed by the drying air, causing lower evaporative cooling rates and thus higher exhausting air temperatures.

The two thermocouples, (the quantity of thermocouples that can be used is not necessarily limited to a specific number by functional use) connected in parallel by the thermocouple sensor level selector switch 106, blend the two millivolt signals into an average of the two values, which is received by the temperature controller 125 at terminals Ⓐ and Ⓑ. The controller 125 continuously compares this signal value against the temperature set point previously set on the controller dial when the automatic moisture control was switched from "manual" to "automatic" mode. If the thermocouple senses a temperature below the controller dial set point temperature, the grain passing the "averaging" or top sensor has a higher moisture content than the moisture level of the grain passing the point when the dial was set; the controller immediately begins to adjust the grain flow rate by gradually slowing the metering roll speed by increments or stages until the temperature sensed by the thermocouples again reaches a balanced or "needle centered" condition.

Likewise, if the thermocouple senses a temperature above the controller dial setpoint temperature, the controller will steadily increase the metering speed by incremental stages until the temperatures set and sensed are balanced. The controller will maintain this needle centered condition until another deviation occurs in the incoming grain condition. The rate at which metering speed changes is controlled by adjusting grain, rate and reset internal control settings on the controller.

The advantage of the novel "early history" and "late history" means of controlling metering speed and thus final moisture is that the final moisture content of the dried grain remains much closer to the final moisture content of the grain being discharged when the dryer automatic moisture control was previously switched to "automatic", than if the unit was set on one manual speed setting and wide moisture fluctuations occurred, or if only a "late history" sensor type of control was used. A spread in final moisture content of plus or minus ¾ to one percentage point of moisture for a five percent change in moisture will occur when drying corn from 25 to 15 percent moisture content, wet basis, with a 220 degree F. operating temperature compared to a single point automatic or manual speed control range in moisture variation of plus or minus 1½ to 3 percentage points under the same grain drying conditions.

Another pair of sensors (not shown) are provided for sensing the temperature of the ambient air around the dryer and for sensing the temperature of the cooling air exiting the grain to be stored. If the difference between these two temperatures are greater than a predetermined amount for a given storage structure, for example greater than 10 degrees, this indicates that the grain exiting the dryer cannot be stored safely in that structure so that more cooling is necessary to achieve the desired storage results. When this condition is sensed, the dryer is shut down temporarily and the plenum level changed. For example, referring to FIG. 2, if the temperature of the grain exiting the dryer is a predetermined amount higher than the desired differential above ambient air around the dryer, then such dryer would be shut down temporarily and the level of the closed plenum divider 43 would be manually set one level higher. That is, the doors 43 which are closed as shown in FIG. 2 would be opened and the doors 43 at the level immediately thereabove would be closed. At the same time, the blocking butterfly valves 47 at the same level as the plenum chamber divider level would be closed and all other butterfly blocking valves 47 would be open. Additionally, the step of closing all doors 51 to close all openings 49 in the corner columns 48 would be accomplished below the closed blocking butterfly valve 47, and all of the doors 51 above the level of the closed butterfly valve 47 would be open. What is accomplished by the changing of the plenum divider level is that now more of the cooling portion of the grain column 28 is being used and less of the heating column. Consequently, the grain exiting the dryer will be cooled adequately, once the grain column level is close to the correct position for adequate cooling. Fine tuning of the cooling temperature differential can be accomplished by adjusting the free air inlet controls, FIG. 1 and FIG. 2. What is really happening is that as much of the drying plenum chamber section 41 is used for drying as is possible in order to get the best use of the energy expended and only as much cooling as is required. If the plenum chamber level divider is too high, it will merely over cool the grain and not harm it, but energy would be wasted in cooling the grain down more than is necessary, and the static pressure level in the heat plenum 41, would be excessive, reducing blower air flow, reducing dryer efficiency and capacity.

Figure 10:
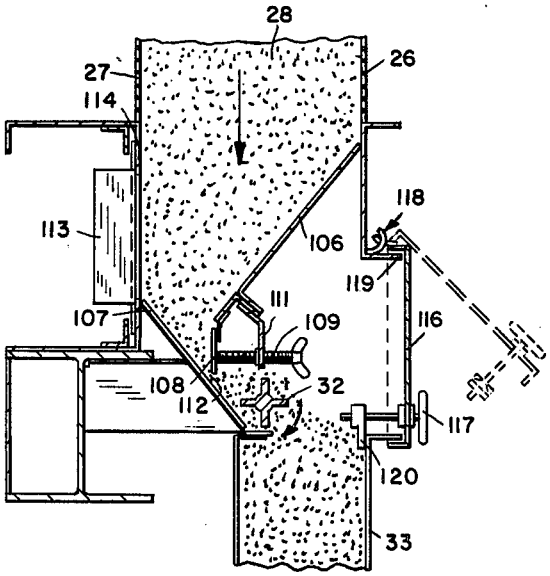
FIG. 10 is an enlarged view of the grain metering apparatus shown in dashed lines in FIG. 8 above the grain collecting hoppers.
Figure 8:
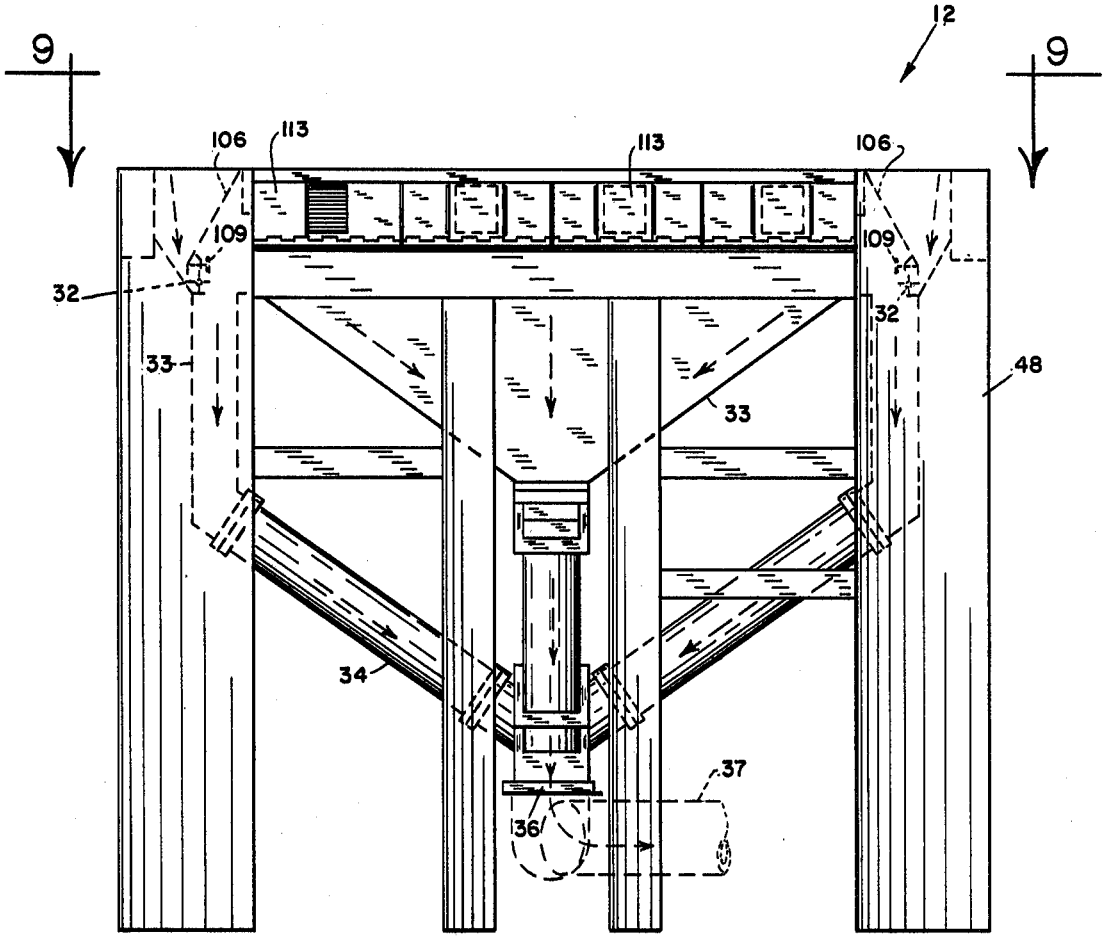
FIG. 8 is a side elevational view of the grain collecting hoppers and gravity flow grain chutes of the present invention at the bottom of the dryer.
Figure 9:
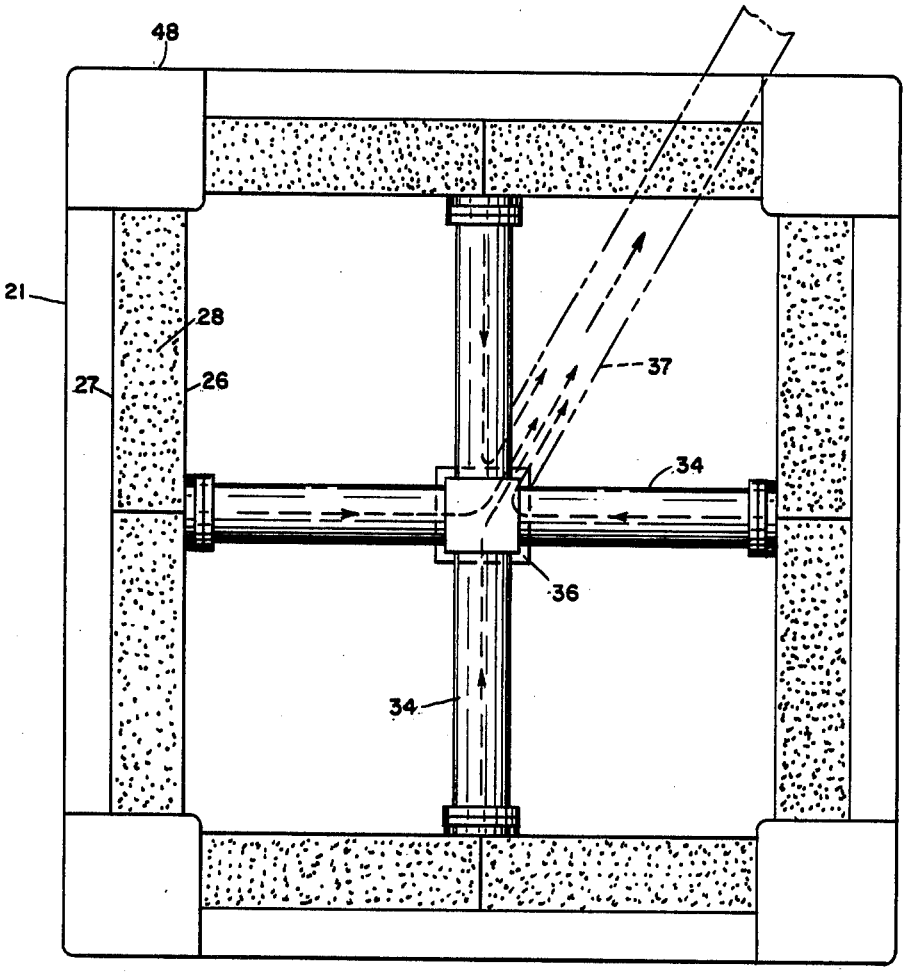
FIG. 9 is a view of the gravity flow grain chutes as they lead to a central receiving hopper and an auxiliary unload conveyor.

Referring more specifically to FIGS. 8–10, and particularly FIG. 10, it is noted that the grain 28 comes down between the perforated walls 26 and 27 onto a slanted surface 106. This slanted surface 106 tapers downwardly to a second slanted wall 107, forming a funnel-shaped hopper. An elongated flapper valve plate 108 extends across the entire length of the grain column 28 underneath and is pivotally attached to the wall 106. An adjustable bolt assembly 109 is threadedly received in a support bracket member 111 rigidly attached to the member 106 and threadably moving this member to the left causes the opening 112 between the member 108 and the member 107 to become smaller, and moving the member 109 outwardly to the right causes the opening 112 to become larger as desired. This can be adjusted to an optimum size such that particles which are substantially larger than the size of a kernel of grain will be trapped above the opening 112 so that they would not harm the metering roll 32 or any other grain conveying or treating machinery to which the grain might become subjected at a later time. Emergency cleanout doors 113 are slidably mounted to a beam structure member 114 for the purpose of providing access to this portion of the grain dryer and, for example, for removing foreign objects which might become lodged just above the opening 112.

It is also possible to have access to the lower portion of the grain dryer 12 by opening a service access door 123, FIG. 1. Once inside the base 12 of the dryer 10, one can open the door 116 by turning the latch structure 117 and removing the door 116, which would substantially span the length of the grain drying column 28 to having access to the adjusting bolt 109 and for inspection of the metering roll 32, which metering roll is substantially merely a rod with paddles thereon which extend entirely across the bottom of the opening 112. This structure shown in FIG. 10 would be duplicated on each of the four sides of the device 10 and the metering rolls 32 geared together on each end thereof such that they operate simultaneously and in synchronization with each other. A motor would be used to turn the metering roll structure 32 in response to the averaged thermocouple millivolt signal referred to above. Once inspection of this structure is complete, the door 116 can again be inserted over the opening 119 by placing a quick remove hinge 118 back in place, pivoting the door 116 downwardly and turning the portion 120 of the latch 117 to the position shown in FIG. 10, by turning the handle thereof.

Accordingly, it can be easily appreciated that this preferred embodiment does indeed accomplish the objects set forth above. Obviously, many modifications and variations of the present invention are possible in light of the above teachings. It is therefore to be understood that, within the scope of the appended claims, the invention may be practiced otherwise than as specifically described.

I claim:

1. Grain drying and conditioning apparatus comprising:

a housing having an outer air impervious skin;

a pair of spaced air pervious walls, for confining a column of grain to be dried, mounted within said housing and forming a column of air between the outermost of said walls and said skin;

a plenum chamber formed between the innermost of said pervious walls;

blower and burner means having an inlet and an outlet, and mounted within said plenum chamber and spaced inwardly from said innermost wall, including an air duct for controlling the direction of air expelled from the blower and burner means, for causing heated air to be forced through a first zone of said column of grain in one direction to heat and extract moisture therefrom and simultaneously causing air for cooling said grain to be pulled through a second zone of said grain column in an opposite direction to the flow of said heated air; and adjustable plenum divider means mounted within the space between the innermost of said walls and said blower and burner means in said plenum chamber for adjusting the relative extent of said zones and dividing said plenum chamber into first and second air flow sections for optimizing the heating and cooling of the grain in said zones, said plenum divider means including means for substantially sealing the first air flow section from the second air flow section.

2. The apparatus of claim 1 wherein said adjustable plenum divider means comprises a plurality of doors at certain specific locations in said space of said plenum chamber, and including means for opening or closing said doors.

3. The apparatus of claim 1 including air blocking means mounted within said air column between said skin and the outermost wall for selectively blocking an air flow in said air column and dividing said air column into first and second regions.

4. The apparatus of claim 3 wherein said blower and burner inlet is in direct communication with the second region of said air column.

5. The apparatus of claim 3 wherein said blocking means is adjustable to and is operable at a certain level in conjunction with said divider means also at the same level to form said first and second regions having substantially the same extent as said first and second air flow sections.

6. The apparatus of claim 5 wherein said air column is substantially unobstructed except where said blocking means is in a closed condition, such that said closed blocking means prevents the passage of air therethrough.

7. The apparatus of claim 3 including means for selectively fluidly communicating a portion of the first region with the inlet to said blower and burner means, for recycling hot air from said first air flow section which is not saturated back through the grain.

8. The apparatus of claim 7 wherein said communicating means comprises an air conduit leading from a point adjacent to the inlet to the blower and burner means to a point adjacent said first region and including means near each said point for selectively opening or closing said conduit.

9. The apparatus of claim 8 including metering means disposed at the bottom of said column of grain for selectively metering the flow of grain out of said column whereby the grain in said column flows downwardly toward an outlet chute.

10. The apparatus of claim 9 including means for trapping foregin objects larger than a predetermined size and throttling grain flow to said metering means.

11. The apparatus of claim 10 wherein said adjusting and trapping means includes means for adjusting said predetermined size.

12. The apparatus of claim 9 including grain turning means connected to said previous walls within said column of grain for causing at least some of the grain adjacent one of said pervious walls to be diverted towards the other of said pervious walls and at least some of the grain adjacent the other of said pervious walls to be diverted towards said one of the pervious walls as the grain within said column of grain flows downwardly towards said metering means.

13. The apparatus of claim 12 wherein said grain turning means is located in said grain column above said point adjacent to said first air flow section.

14. The apparatus of claim 13 including second, third and fourth pairs of spaced air pervious walls for confining second, third and fourth columns of grain, and forming second, third and fourth air columns between the outermost pervious wall and said skin, second, third and fourth air blocking means mounted within each respective air column and second, third and fourth means for selectively communicating a portion of the first section of each respective air column with the inlet to said blower and burner means for recycling hot air which is not saturated back through the grain, the first said communicating means and said second, third and fourth communicating means being disposed at each of four corners of said housing and being respectively interposed between said air columns.

15. The apparatus of claim 13 including air exhaust means connected to said skin and air communication means connected to said skin below said exhaust means but above at least one of the levels of said plenum divider means, means for selectively opening or closing said air communication means whereby when said plenum divider means is below said air communication means, said air communication means can be opened to allow air to exhaust therethrough and when said plenum divider means level is located below said air communication means, said air communication means can be opened to allow cooling air to enter.

16. The apparatus of claim 13 including a free air inlet means connected to said housing for allowing air to enter the inlet of said blower and burner means without first passing through said column of grain.

17. The apparatus of claim 13 wherein said grain turning means is substantially at the midpoint of the first zone of said grain column.

18. The apparatus of claim 13 wherein a plurality of grain turning means are disposed within said grain column.

19. The apparatus of claim 3 including a first sensing means disposed in the first zone of said grain column spaced closer to said air exhaust means than to said blocking means, and second sensing means disposed in said first zone of said grain column and being spaced closer to said blocking means than to said air exhaust means;

said first and second sensing means being connected in parallel whereby the outputs of said sensing means are averaged into an averaged output signal; and means for controlling said metering means in response to the averaged signal from said first and second sensing means.

20. The apparatus of claim 19 wherein said first and second sensing means are thermocouples and whereby a signal corresponding to a lower than desired average temperature signal will cause more grain to pass through the metering means and a signal corresponding to a higher than desired temperature signal will automatically cause less grain to pass through the metering means.

21. The apparatus of claim 19 including a third sensing means and selector switch means for selectively connecting whichever of said second and third sensing means which is closest to said plenum divider level to be in parallel with said first sensing means and simultaneously disconnecting the connection of the other sensing means in parallel with said first thermocouple.

22. The apparatus of claim 21 wherein said first, second and third sensing means include thermocouples for sensing temperature.

23. The apparatus of claim 19 including a temperature sensing means for sensing the temperature of the air outside of said apparatus and a temperature sensing means for sensing the temperature of the grain near said metering means and means for shutting down said grain drying apparatus when the difference between the temperature of the grain exiting the metering means and the outside air is more than a predetermined amount so that said adjustable plenum divider means can be readjusted to decrease the extent of the first zone and increase the extent of the second zone.

24. Grain drying and conditioning apparatus comprising:

a housing having an outer air impervious skin;

a pair of spaced air pervious walls, for confining a column of grain to be heated and dried, mounted within said housing and forming thereby column of air between the outermost of said walls and said skin;

blower and burner means for causing heated air to be forced through a first zone of said column of grain in one direction to heat and extract moisture therefrom and simultaneously causing air for cooling said grain to be pulled through a second zone of said grain column in an opposite direction to the flow of said heated air;

plenum divider means mounted between the innermost of said walls and said blower and burner means for selectively adjusting the vertical extent of said zones;

first means adjustably formed on said skin for permitting the passage of air therethrough;

second means mounted within said air column for adjustably blocking the vertical flow of air therewithin and forcing said air to move horizontally;

third vertical duct means formed at the corners of said walls and of said skin for gathering said horizontally moved air and for moving said air downwardly from the first zone to below said blower and burner means; and means for controlling said first, second and third means.

25. The apparatus of claim 24 including first sensing means mounted above said divider means for sensing the exhaust condition of said heated air, and said sensing means operatively connected to said control means.

26. The apparatus of claim 25 including second sensing means mounted above said first sensing means for detecting the moisture condition of the uppermost portion of the grain, and means for averaging said first and second sensing means results for application to said control means.

27. The apparatus of claim 26 including at least one more additional sensing means for further detecting the moisture condition of other portions of said grain column, and means for averaging the outputs of said first, second and additional sensing means for more precise operation of said control means.

28. The apparatus of claim 26 including grain turning means disposed in said grain column for causing the outermost grain thereof to be diverted inwardly and the innermost grain thereof to be diverted outwardly as the grain moves downwardly through said grain turning means.

29. The apparatus of claim 28 wherein said third means includes a plurality of vertically spaced sets of door valves, each set placed in horizontal relation with said second means whereby to selectively block or permit the horizontal flow of air into said duct means at said set location.

30. A control system for a grain drying apparatus of a type having a housing with an air pervious skin, a pair of spaced air pervious walls for confining a column of grain to be dried mounted within said housing and thereby forming a column of air between the outermost of said walls and said skin, blower and burner means for causing heated air to be forced through said column of grain in one direction to heat and extract moisture therefrom, said control system comprising:

a first means for sensing the condition of the air passing through the grain at one point in the grain column and producing a first output signal;

a second means for sensing the condition of the air passing through the grain at another point in the grain column and producing a second output signal;

averaging means for receiving and averaging said first and second output signal and producing an averged output signal; and metering means for receiving said averaged output signal and metering grain out of said grain drying apparatus in response to said averaged output signal.

31. A method of drying and conditioning grain in a grain drying apparatus of a type including:

a housing having an outer air impervious skin; a pair of spaced air pervious walls, for confining a column of grain to be dried, mounted within said housing and forming a column of air between the outermost of said walls and said skin; a plenum chamber formed between the innermost of said pervious walls; blower and burner means having an inlet and an outlet, and mounted within said plenum chamber and spaced inwardly from said innermost wall, including an air duct for controlling the direction of air expelled from the blower and burner means, for causing heated air to be forced through a first zone of said column of grain in one direction to heat and extract moisture therefrom and simultaneously causing air for cooling said grain to be pulled through a second zone of said grain column in an opposite direction to the flow of said heated air; and adjustable plenum divider means mounted within the space between the innermost of said walls and said blower and burner means in said plenum chamber for adjusting the relative extent of said zones and dividing said plenum chamber into first and second air flow sections for optimizing the heating and cooling of the grain in said zones, said plenum divider means including means for substantially sealing the first air flow section from the second air flow section, said method comprising:

introducing grain to be dried and conditioned into said grain column at one end thereof adjacent said first zone;

removing grain from said grain column at another point thereof adjacent said second zone; and optimizing the extend of relative heating and cooling of the grain by controlling the relative extent of said first and second zones by adjusting the position of said plenum divider means.

32. The method of claim 31 including the step of turning the grain as it moves through the first zone of the grain column and thereby causing the outer grain in the grain column to be moved inwardly and the inner grain in the grain column to be moved outwardly.

33. The method of claim 32 including the step of recirculating heated non-saturated air that has passed through the grain column back to the inlet of the blower means for blending with unheated air before entering the combination of heated and unheated air into the blower and burner means.

34. The method of claim 33 including the step of controlling the output of grain from said grain column in the second zone in response to the average of sensed conditions at least two points adjacent the grain column in said first zone.

35. The method of claim 34 wherein the condition sensed at said at least two points is temperature.

* * * * *